United States Patent [19]

Chen

[11] Patent Number: 5,071,278

[45] Date of Patent: Dec. 10, 1991

[54] SELF-FEEDING PAINT BRUSH

[76] Inventor: Hui-Pi Chen, No. 9, Lane 24, Tung Shing St., Shulin, Taipei Hsien, Taiwan

[21] Appl. No.: 620,109

[22] Filed: Nov. 30, 1990

[51] Int. Cl.[5] ..... A46B 11/02; A46B 11/06

[52] U.S. Cl. ..... 401/146; 401/149; 401/150; 401/188 R

[58] Field of Search ..... 401/143, 146, 149, 150, 401/188 R, 197

[56] References Cited

U.S. PATENT DOCUMENTS 3,676,010 7/1972 Kirch ..... 401/188
3,977,797 8/1976 Paterson ..... 401/197 X

FOREIGN PATENT DOCUMENTS 41594 2/1933 France ..... 401/188
63-1675 1/1988 Japan ..... 401/150

*Primary Examiner*—Steven A. Bratlie
*Attorney, Agent, or Firm*—Lowe, Price, LeBlanc & Becker

[57] ABSTRACT

A self-feeding paint brush of the type comprising a housing, an upper deck, a paint container, a transmission mechanism and a brush assembly, wherein a control switch is made on the brush assembly to turn on a motor to drive a gear set to operate via a pinion and a driving gear, causing a suction chamber to suck up oil paint from the paint container into a guide tube via two ducts, for further distribution over the bristles of the brush assembly through a nozzle tube. The housing is releasably secured to the paint container at the top by a hook-and-ring connection to facilitate oil paint filling operation.

1 Claim, 6 Drawing Sheets

SELF-FEEDING PAINT BRUSH

BACKGROUND OF THE INVENTION

The present invention relates to self-feeding paint brushes, and more particularly to a self-feeding paint brush which is easy to operate and can be conveniently dismounted for wash.

FIGS. 1 and 2 illustrate an oil paint distribution system in a self-feeding paint brush according to the prior art. One disadvantage of this structure is that the oil paint intake and outlet pipings A and B are fixedly fastened inside the housing C of the device which are difficult to clean. Another disadvantage of this structure is that a plate spring E is controlled by a press button D to connect or disconnect power supply, which plate spring E may trip to stop the distribution of oil paint during painting. Interruption of oil paint supply during painting process will greatly affect the quality in application of oil paint on a wall surface.

SUMMARY OF THE INVENTION

The present invention has been accomplished to eliminate the aforesaid problems. According to the present invention, there is provided a self-feeding paint brush comprising a housing, an upper deck, a paint container, a transmission mechanism and a brush assembly. The housing is releasably secured to the paint container at the top by means of a hook-and-ring connection to facilitate the oil paint filling operation. The brush assembly has a control switch for controlling a motor to drive a gear set to operate via a pinion and a driving gear, causing the suction chamber to suck up oil paint from the paint container into a guide tube via two ducts, for further distribution over the bristles of the brush assembly through a nozzle tube.

DETAILED DESCRIPTION OF THE PREFERRED EMBODIMENT

Figure 1:
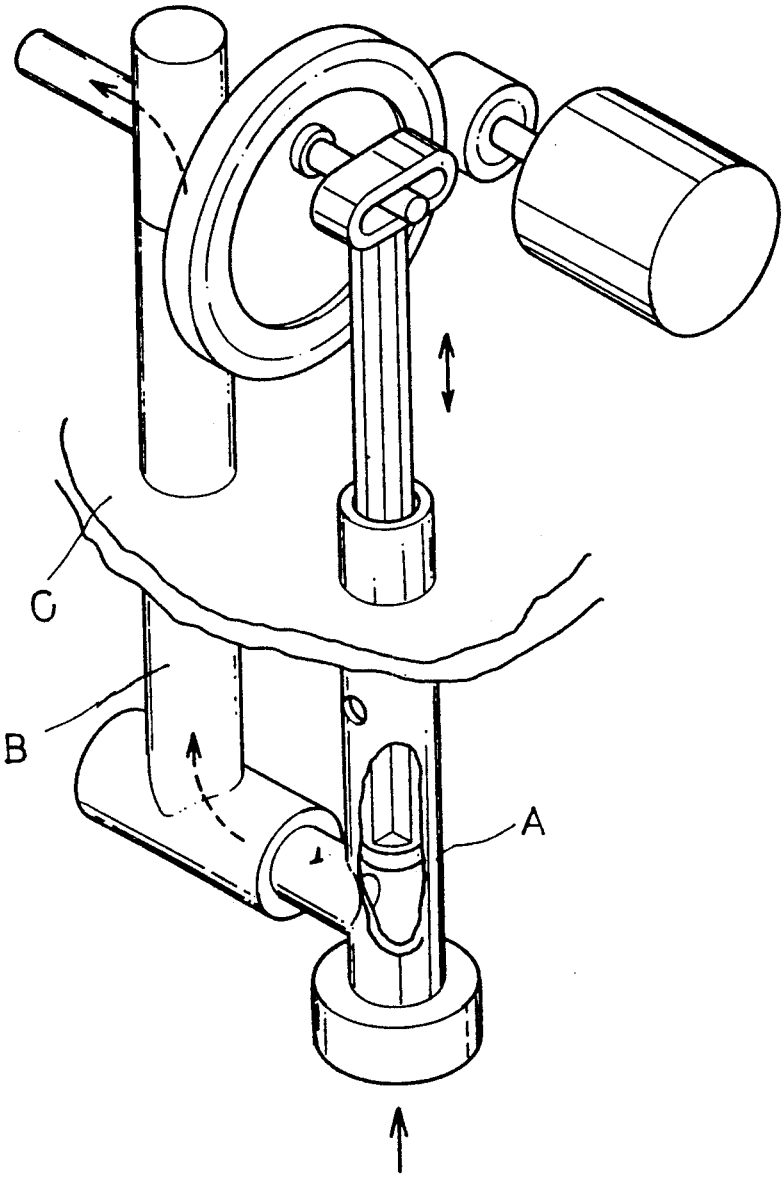
FIG. 1 PRIOR ART
FIGS. 1 and 2 illustrate an oil paint distribution system in a self-feeding paint brush according to the prior art.
Figure 2:
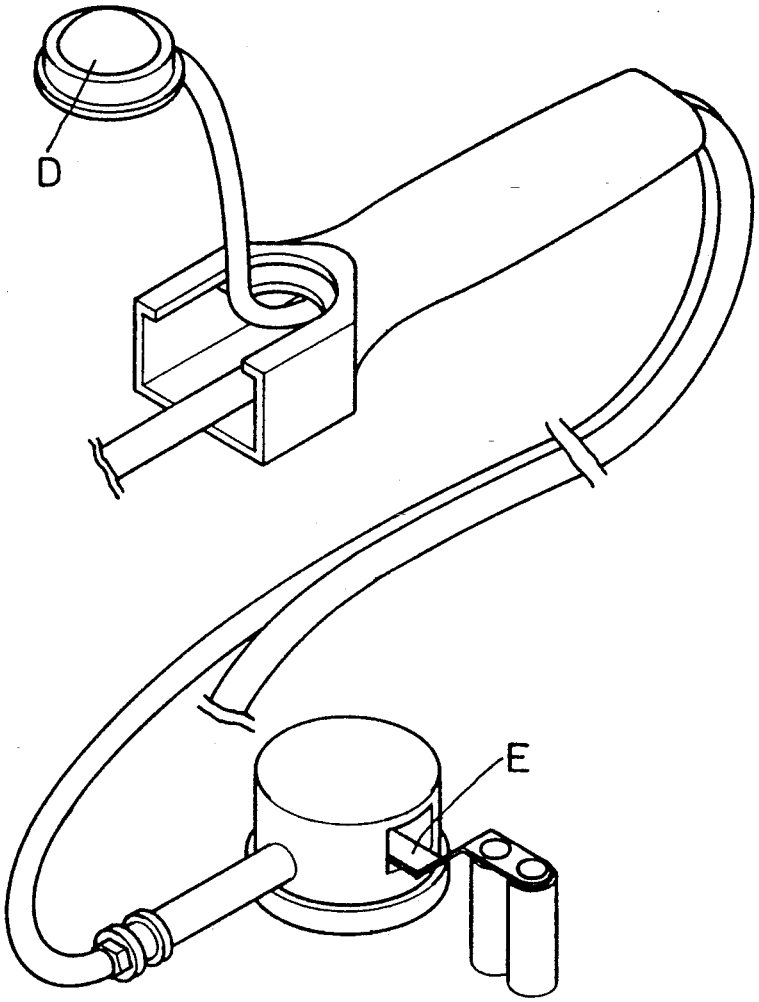
FIG. 2 PRIOR ART
Figure 3:
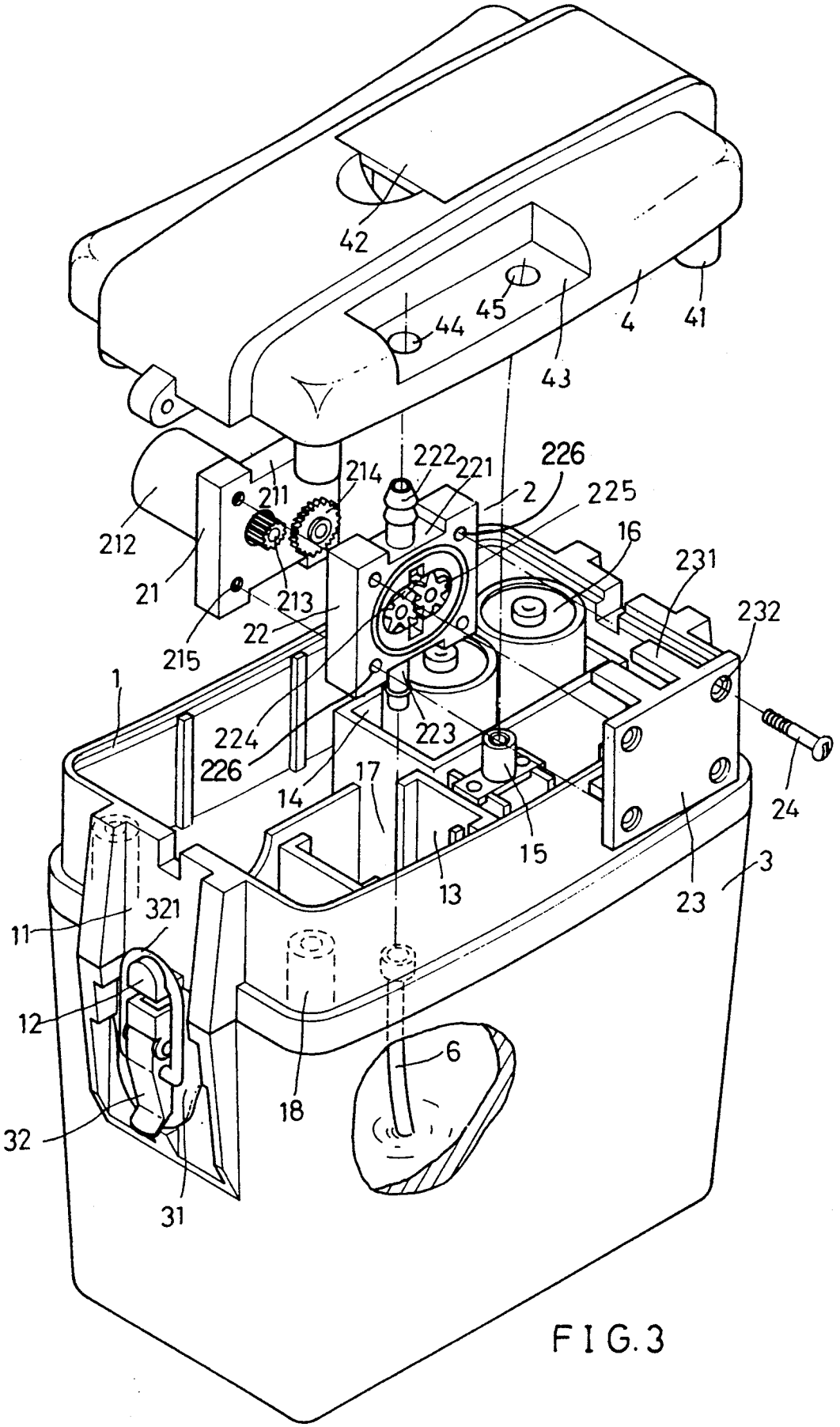
FIG. 3 is a perspective dismantled view of the preferred embodiment of self-feeding paint brush of the present invention.
Figure 4:
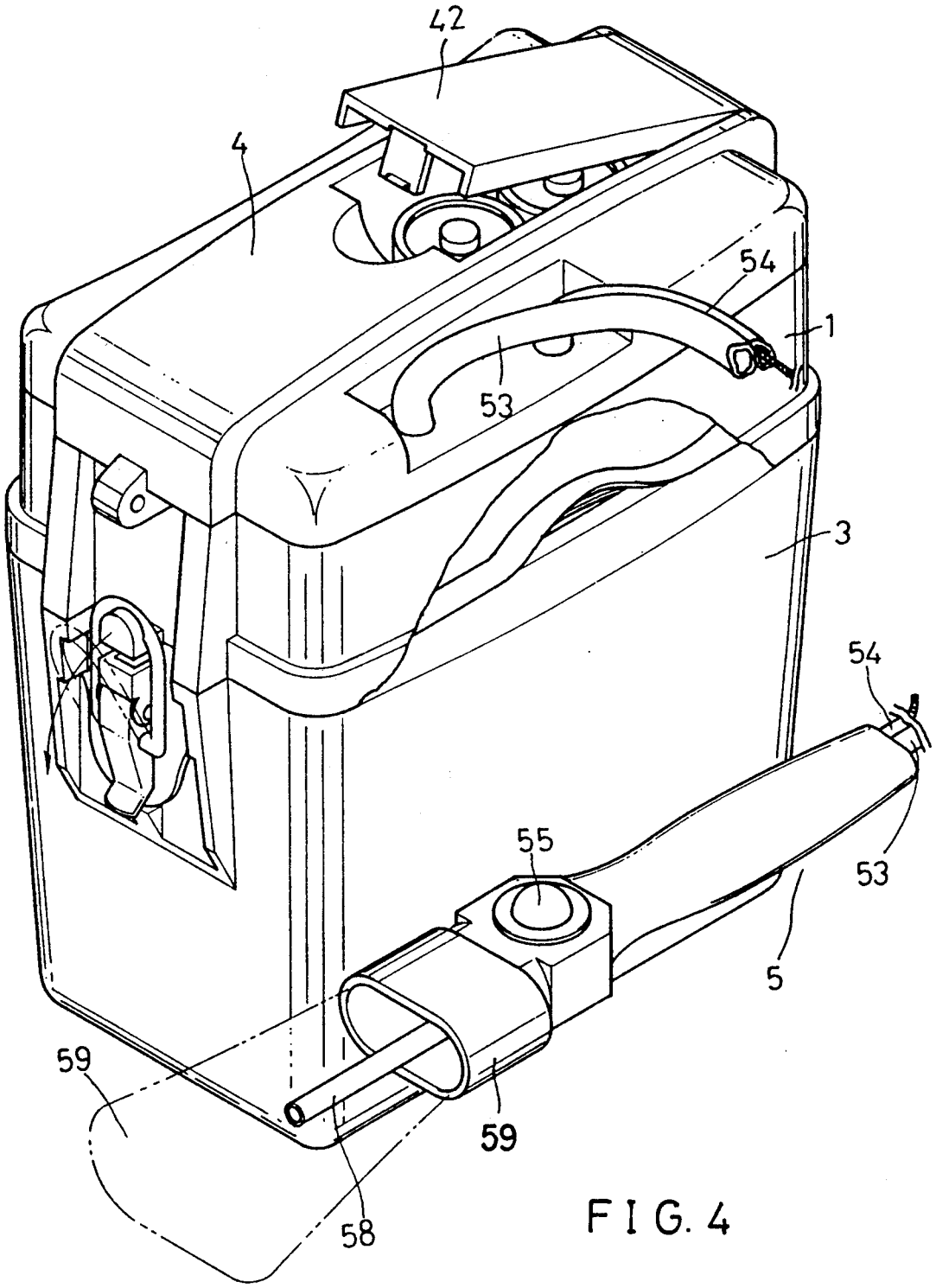
FIG. 4 is a perspective and partly sectional view of the preferred embodiment of the present invention.
Figure 5:
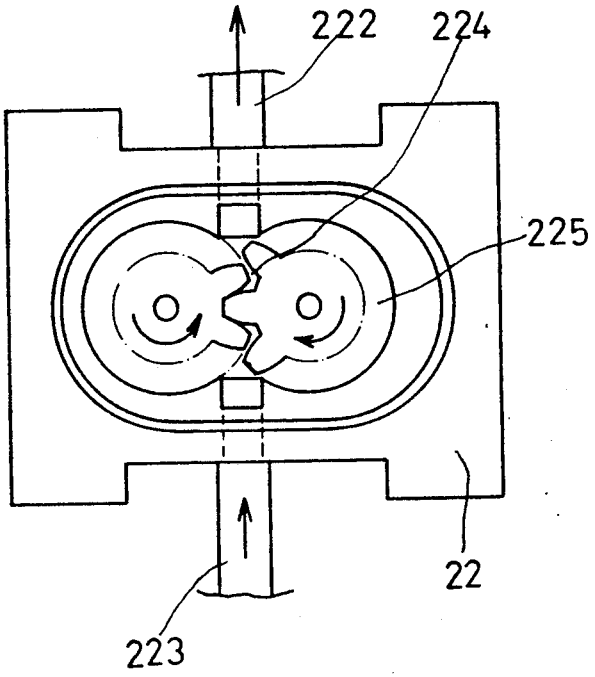
FIG. 5 is a schematic plan view of the control block of the transmission mechanism of the preferred embodiment of the present invention.
Figure 6:
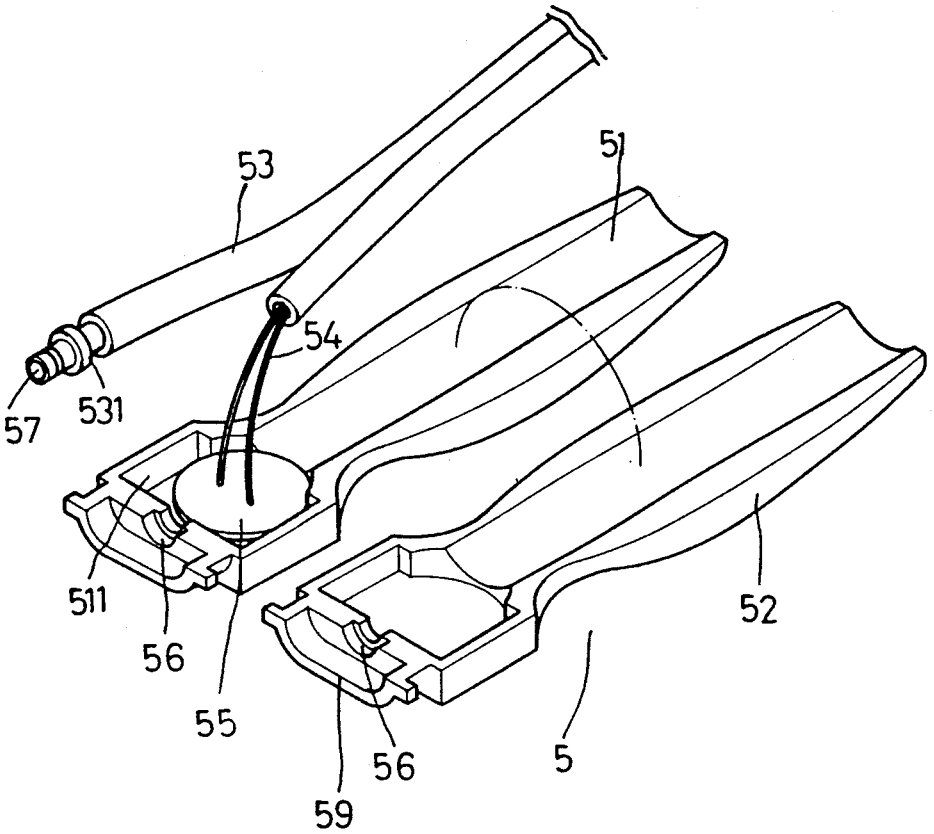
FIG. 6 is a perspective dismantled view of the brush assembly of the preferred embodiment of the present invention.

Referring to the annexed drawings in greater detail, therein illustrated is a self-feeding paint brush embodying the present invention and generally comprised of a housing 1, a transmission mechanism 2, a paint container 3, an upper deck 4, and a brush assembly 5.

The housing 1 comprises two recessed portions 11, which have each a hook 12 for fastening the paint container 3, made on the outer wall surface thereof at two opposite ends, a motor mounting chamber 13, a battery chamber 14 and a power socket 15 respectively disposed at the top. The power socket 15 is provided for connection thereto of the brush assembly 5 through an electric line 54 permitting the brush assembly 5 to be controlled to operate by a control switch 55. The battery chamber 14 is provided for holding a battery set 16 which provides the present device with all necessary working voltage. The motor mounting chamber 13 has a notch 17 at one side, and a suction tube 6 inserted in the paint container 3 for distribution of paint to the brush assembly 5. There are a plurality of columns 18, which are internally screw threaded, inside the housing 1 at the corners thereof for mounting the upper deck 4 by screws.

The transmission mechanism 2 is comprised of a motor holder 21, a control block 22 and a mounting plate 23. The motor holder 21 has two notches 211 made thereon at two opposite ends and vertically aligned, a plurality of bolt holes 215 at suitable locations for mounting, and a motor 212 attached thereto at one side, which motor 212 has a pinion 211 fastened in the driving shaft thereof and engaged with a gear 214. The control block 22 has two notches 221 made thereon at two opposite ends and vertically aligned, a suction chamber 224 between said two notches 221 for mounting a gear set 225 which is driven to rotate by the gear 214, and a plurality of holes 226 respectively made at locations corresponding to the bolt holes 215 of the motor holder 21, wherein two ducts 222 and 223 are respectively fastened in the two notches 221 for distribution of paint coming from the suction tube 6. The mounting plate 23 has a plurality of projecting strips 231 transversely disposed at the top as well as the bottom, and a plurality of countersunk holes 232 respectively made at locations corresponding to the through-holes 226 of the control block 22 and the bolt holes 215 of the motor holder 21. When the motor holder 21 is attached to the mounting plate 23 with the control block 22 squeezed in therebetween, the projecting strips 231 of the mounting plate 23 are respectively engaged in the notches 211 and 221 to firmly retain the motor holder 21 and the control block 22, and the countersunk holes 232 are respectively aligned with the holes 226 and the bolt holes 215 permitting the motor holder 21, the control block 22 and the mounting plate 23 to be fixedly secured together by a plurality of screw bolts 24. After assembly, the transmission mechanism 2 is fastened in the motor mounting chamber 13, permitting the motor 212 to protrude beyond the notch 17, and permitting the bottom duct 223 to be connected to the suction tube 6.

The paint container 3 has two recessed portions 31 made on the outer wall surface thereof at two opposite ends. Two retainer loops 321 are respectively fastened in two blocks 32 which are respectively made on the two recessed portions 31 of the paint container 3. By fastening the retainer loops 321 to the two hooks 12 of the two recessed portions 11 of the housing 1, the housing 1 can be firmed secured to the paint container 3 at the top.

The upper deck 4 has a plurality of columns 41 which are internally screw threaded for connection to the columns 18 by screw means, a battery cap 42 and a recessed flat surface 43 at the top. The battery cap 42 is disposed at such a location to cover the battery chamber 13 when the upper deck 4 is fixedly secured to the housing 1. By removing the battery cap 42, the battery set received inside the battery chamber 13 can be conveniently replaced. Two holes 44 and 45 are respectively made on the recessed flat surface 43, wherein the hole 44 is provided for fastening the upper duct 222 of the control block 22 of the transmission mechanism 2 permitting the guide tube 53 of the brush assembly 5 to be connected thereto, the other hole 45 is provided for mounting the power socket 15 permitting the electric line 54 of the brush assembly 5 to be connected thereto.

The brush assembly 5 comprises a housing formed of two symmetric shells 51 and 52 for holding the guide tube 53 and the electric line 54, having a connecting end 59 at the front for mounting a brush 591. The upper shell 51 defines therein a receiving space 511 for mounting the control switch 55 which has one end electrically connected with the electric line 54, and an opposite end protruding beyond the outer surface of the upper shell 51 for operation. A stepped hole 56 is provided inside the brush assembly 5 at the center for fastening the collar 531 of the guide tube 53, permitting the terminal end 57 of the guide tube 53 to protrude at the front for fastening a nozzle tube 58. After the brush 591 is fastened in the connecting end 59 of the brush assembly 5, the nozzle tube 58 is received inside the brush 591 so that paint from the paint container 3 can be widely distributed over the brush 591 for painting.

By unfastening the retainer loops 321 from the hooks 12, the housing 1 can be removed from the paint container 3 for filling oil paint into the paint container 3. After filling of oil paint, the device is ready for applying paint on any desired wall surface. Through the control of the control switch 55, electric power from the battery set 16 is connected through the electric line 54 and the power socket 15 to turn on the motor 212 of the transmission mechanism 2, permitting the pinion 211 to drive the gear set 225 to rotate via the gear 214. The rotation of the gear set 225 causes the suction chamber 224 to be in a vacuum status so that oil paint can be sucked up through the suction tube 6 into the ducts 223 and 222 for further distribution to the brush 591 through nozzle tube 58 via the guide tube 53.

Because power supply is controlled by the control switch 55 through the electric line 54 and the power socket 15, it will not be interrupted during distribution of oil paint. Because the housing 1 is detachably attached to the paint container 3 by means of the engagement between the retainer loops 321 and the hooks 12, the housing 1 can be conveniently stably removed from the paint container 3 without shaking the paint container 3. Further the transmission mechanism 2, the suction tube 6, the guide tube 54 and the nozzle tube 58 form a paint distribution loop which can efficiently eliminate blocking problems.

What is claimed is:

1. A self-feeding paint brush of the type comprising a housing, a transmission mechanism, a paint container, an upper deck and a brush assembly, characterized in that:

said housing comprises at the outside two hooks on two opposite, recessed portions, and at the inside a motor mounting chamber, said motor mounting chamber having a suction tube extending downward at the center, a battery chamber for holding a battery set, and a power socket connected to said battery set, and a plurality of internally screw threaded columns;

said upper deck comprises a plurality of internally screw threaded columns for connection to the columns of said housing by screw means, a battery cap releasably disposed to cover said battery chamber, and a recessed flat surface at the top, said recessed flat surface having two through-holes made thereon;

said transmission mechanism is comprised of a motor holder, a control block and a mounting plate respectively connected together, said motor holder having two notches at two opposite ends, a plurality of bolt holes and a motor attached thereto at one side for driving a driving gear through a pinion, said control block having two notches at two opposite ends, a suction chamber defined therein for mounting a gear set, said gear set being carried to rotate by said driving gear, a plurality of through-holes corresponding to said bolt holes on said motor holder, and two ducts respectively disposed at two opposite ends of which the upper duct is fastened in either one of the two through-holes on said recessed flat surface of said upper deck and the bottom duct is connected to said suction tube, said mounting plate having a plurality of projecting strips transversely extending therefrom at the top and the bottom and respectively disposed to press on the notches on said motor holder and said control block for retaining said motor holder and said control block, and a plurality of countersunk holes respectively made at locations corresponding to the through-holes on said control block and the bolt holes on said motor holder for connection by a plurality of screw bolts;

said paint container has two retainer loops on two raised blocks at two recessed portions on the outer wall surface thereof at two opposite ends for engaging with said two hooks of said housing permitting said housing to be secured thereto at the top;

said brush assembly comprises a casing formed of two symmetric shells, having a connecting end for mounting a brush, a stepped hole at the inside for mounting a guide tube, a control switch connected to said power socket through an electric line to control the operation of said motor, said electric line being inserted through one of the two through-holes on said recess flat surface of said upper deck and electrically connected to said power socket, said guide tube having one end inserted through the other of the two through-holes on said recessed flat surface of said upper deck to connect to said suction tube through the two ducts of said control block and an opposite end inserted through said stepped hole and secured in place by a collar for connection thereto of a nozzle tube, said nozzle tube being concealed in a plurality of bristles fastened in said brush for distributing oil paint from said paint container over said bristles.

* * * * *